US007147394B2

(12) United States Patent
Möck

(10) Patent No.: US 7,147,394 B2
(45) Date of Patent: Dec. 12, 2006

(54) WRITING INSERT WITH NON-DESTRUCTIVE FINAL INSPECTION

(75) Inventor: Gerhard Möck, Kirchehrenbach (DE)

(73) Assignee: Schwan-Stabilo Schwanthausser GmbH & Co. KG, Heroldsberg (DE)

( * ) Notice: Subject to any disclaimer, the term of this patent is extended or adjusted under 35 U.S.C. 154(b) by 238 days.

(21) Appl. No.: 10/477,536

(22) PCT Filed: May 10, 2002

(86) PCT No.: PCT/EP02/05188

§ 371 (c)(1),
(2), (4) Date: May 5, 2004

(87) PCT Pub. No.: WO02/092360

PCT Pub. Date: Nov. 21, 2002

(65) Prior Publication Data

US 2004/0175225 A1 Sep. 9, 2004

(30) Foreign Application Priority Data

May 14, 2001 (DE) ..... 101 23 279

(51) Int. Cl.
*B43K 5/12* (2006.01)
*B43K 5/16* (2006.01)

(52) U.S. Cl. ..... 401/192; 401/103

(58) Field of Classification Search ..... 401/103, 401/109–114, 192, 212
See application file for complete search history.

(56) References Cited

U.S. PATENT DOCUMENTS 2,549,227 A 4/1951 Ostrander ..... 15/134
2,905,147 A * 9/1959 Johmann ..... 401/103
2,989,032 A * 6/1961 Bross ..... 401/103
3,051,132 A * 8/1962 Johmann ..... 401/103
5,192,154 A 3/1993 Moeck
5,984,556 A * 11/1999 Gray et al. ..... 401/192

FOREIGN PATENT DOCUMENTS

| | | |
|---|---|---|
| DE | 1561826 | 1/1972 |
| DE | 90 06 783.5 | 10/1990 |
| DE | 4343880 A1 | 6/1995 |
| EP | 0461292 A1 | 12/1991 |
| EP | 1072 440 A2 | 1/2001 |
| FR | 1 479 022 | 4/1967 |
| GB | 746815 | 3/1956 |
| JP | 10-157379 | 6/1998 |

* cited by examiner

*Primary Examiner*—David J. Walczak
(74) *Attorney, Agent, or Firm*—Bachman & LaPointe, P.C.

(57) ABSTRACT

A writing insert for a writing implement, in particular for a fineliner writing implement. The writing insert includes a writing member with a writing tip, a casing part with a through cavity in which the writing member is at least partially accommodated and from the one end of which the writing member projects with the writing tip, a guide device connected to the casing part for guiding the writing member and a spring element which elastically biases the writing member in the direction of the writing tip. The instrument provides that the casing part is made from a transparent material, preferably a transparent plastic material.

14 Claims, 1 Drawing Sheet

WRITING INSERT WITH NON-DESTRUCTIVE FINAL INSPECTION

Figure 1:
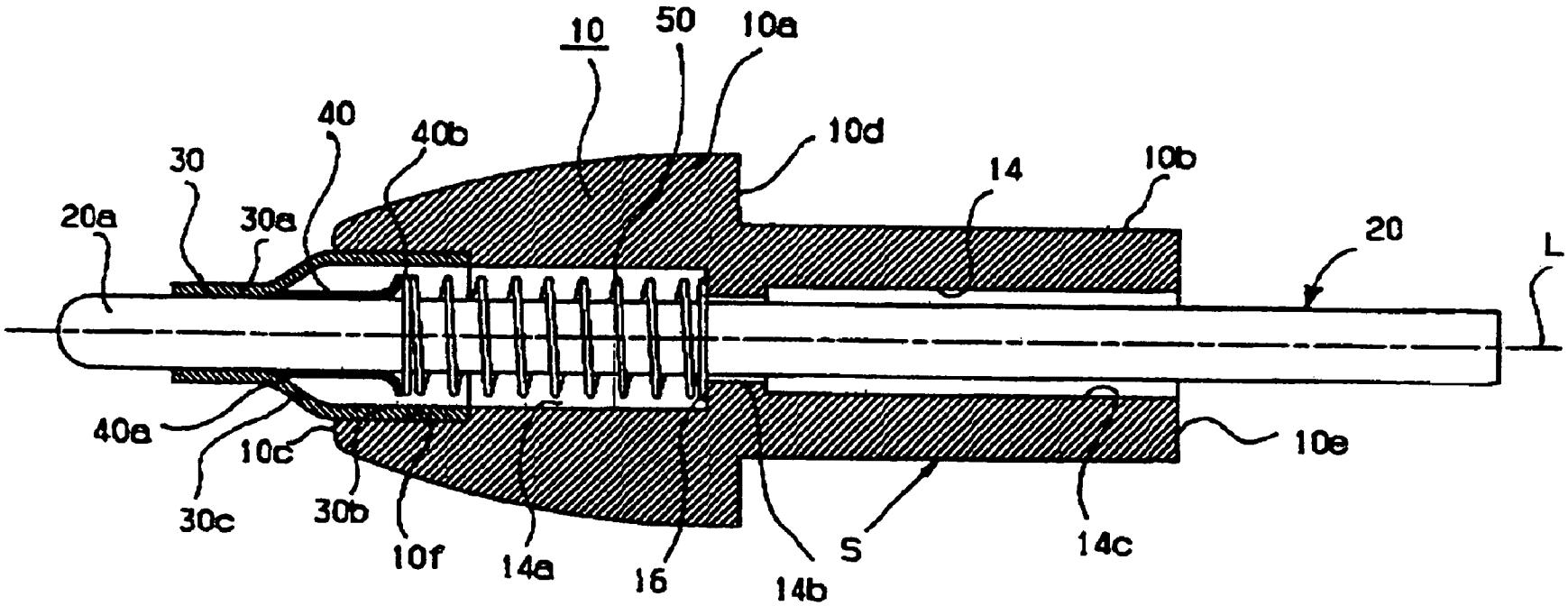

The present invention relates to a writing insert for a writing implement and the like, in particular for a fineliner writing implement, as set forth in the classifying portion of claim 1.

Depending on the respective structure and material used for the writing member of a writing implement, structural measures must be taken to avoid damage to the writing member during the writing operation. That applies in particular in regard to the writing members of so-called fineliner writing implements, which are of diameters in the range of between 0.2 mm and 1.5 mm and which are mostly made from plastic materials such as polyamide, polyester, polypropylene, polyacetal and the like. In their interior those writing members have capillary spaces for conveying the writing fluid from a fluid reservoir to the writing tip of the writing member. As, when writing, depending on the respective user, very high forces can act on the writing tips of the fineliner writing members, those tips are easily bent. In addition they more or less easily wear away, because of the roughness of the surfaces on which the writing is being produced.

To avoid damage therefore the writing tips or the writing members of such writing implements are fixed by means of holders of a stiff material such as metal by for example clamping. If in that situation the clamping action is excessively loose, the writing member is irreversibly pressed into the writing implement and as a result the writing implement becomes useless. If in contrast the clamping action is too firm, the writing member is admittedly more stable and steady, but there is the danger that the capillary spaces in the writing member are reduced or entirely closed off. For that reason and as a consequence of the small diameter of fineliner writing members, the construction of writing implements of that kind involves the necessity of precise matching co-ordination with very small dimensional tolerances.

European patent application No 0 461 292 which forms the most relevant state of the art which the present invention takes as its basic starting point proposed for that purpose imparting axial mobility to the writing member of a fineliner writing implement, by means of a high-precision elastomer sleeve. For that purpose the writing insert has a holder which forms a cavity, in the interior of which the elastomer sleeve is arranged. At its one end, the elastomer sleeve is supported against the writing member by way of a clamping ring while at its other end it is supported against the holder. The writing insert is disposed in a bore in the lower part of the writing implement. In that arrangement, the outside periphery of that part of the writing implement is of a smaller diameter than the rest of the writing implement so that the available space is extremely limited.

An excessively high writing pressure can be compensated by virtue of use of the elastomer sleeve as the writing tip of the writing member can be for example completely pushed back into the holder surrounding it. That prevents it from bending over radially. In addition the elastic mounting of the writing member also reduces the wear at the writing tip and provides for enhanced writing comfort.

That structure which in itself has proved its worth however requires a series of components which, by virtue of their small size, are complicated to produce and which, as a consequence of the limited amount of space available in the lower part of the writing implement, are difficult to fit. In addition, precise fitting is necessary for a writing implement which is to be used over a long period of time. As on the one hand, as was already mentioned hereinbefore, only very small dimensional tolerances can be allowed for the individual components and on the other hand the assembly procedure is very substantially effected by machine for cost reasons, there is therefore the need to perform a quality control operation at the end of the production process. Hitherto, a quality control procedure of that kind can be implemented only by functional control and inspection of the respective writing implement, but that is labor-intensive and thus cost-intensive. As furthermore the individual components of a writing implement, for cost reasons, are very substantially assembled to each other by joins which involve flow of the materials involved and which are thus non-separable, the quality control operation in respect of the components disposed in the interior of the writing implement can only be effected by destroying it. That however is also out of the question, for cost reasons.

In addition British patent No 746 815 discloses a writing implement which is provided for labelling housings, packets and the like. The writing member of that known writing implement is formed by a felt material which is intended to be replaceable as it wears away quickly on the rough surfaces for which that known writing implement is intended. In that case, the writing insert itself comprises a plurality of individual parts which are screwed together by way of a total of five screwthreads. In that known writing implement, the use of screwthreads permits non-destructive quality control. In comparison however the use of screwthreads on a writing implement presupposes certain minimum diameters for the writing implement, so that this structure in particular cannot be used for the above-mentioned fineliner writing implements. In addition production of the screwthreads give rise to additional costs.

The object of the present invention is to provide a writing insert of the kind set forth in the opening part of this specification, in particular for fineliner writing implements, which, while being of a simple and inexpensive structure, permits non-destructive final inspection.

The foregoing object is attained by the features of claim 1. Subsequent claims 2 through 17 set forth advantageous design configurations in that respect.

The use of a transparent material, preferably a transparent plastic material, for the casing part, easily affords the possibility of implementing non-destructive quality control, in particular at that location of a writing implement, which is particularly important in terms of functional suitability of the implement. In particular it is possible to check the arrangement and the functional efficiency of the spring element. In addition the transparent nature of the casing part affords the possibility of clearly revealing to the user of the writing implement the complex structure and in particular the resilient retraction movement so that he can recognise and appreciate the high quality of the writing implement.

The design configuration of the casing part of the writing implement, such that the spring element is supported directly at the casing part, means that it is possible to forego the use of a separate component for that supporting function, as is the case in European patent application No 0 461 292. As a result the inside diameter of the through cavity is enlarged so that it is possible to use a coil spring, preferably of metal, as the spring element. A coil spring firstly has the advantage that it can be produced with a well-defined modulus of elasticity, which substantially improves the quality of such writing implements. In addition, coil springs can be produced with a high level of accuracy and less expensively than a high-precision elastomer sleeve. Furthermore in particular metal coil springs are not subject to any ageing influences or do not involve chemical reactions with the writing fluid used, as is the case with the elastomer sleeve in the state of the art. Also the coil spring affords the possibility of being able to provide a long spring travel for the writing member.

Coil springs of metal of that kind are not influenced by external influences, in particular by the passage of time or chemical reactions with the writing fluid used.

In this connection it is to be noted that the reference to direct support for the elastic element at the casing part is also used to denote the interposition of annular disks or the like between the end of the elastic element which faces towards the support surface of the casing part, and the casing part.

Support for the spring element against the casing part can be achieved by the through cavity of the casing part having at least one first cavity portion in which the spring element is accommodated and a second cavity portion whose inside diameter is smaller than the inside diameter of the first cavity portion. The spring element can then be supported against the transitional step which is formed at the transition of the first cavity portion to the second cavity portion and which forms a support surface preferably extending perpendicularly to the longitudinal central axis of the writing member.

In order to achieve stable guidance for the writing member, it can further be provided that the inside diameter of the second cavity portion corresponds to the outside diameter of the writing member. In order to facilitate assembly of the writing member in such a situation, the edges at the front ends of the second cavity portion can be provided with introduction bevels.

If the second cavity portion is adjoined by a third cavity portion whose inside diameter is preferably larger than the inside diameter of the second cavity portion, that makes it possible to achieve a saving in material. In this connection it is to be pointed out that the inside diameter of the third cavity portion can be smaller than the inside diameter of the first cavity portion.

The casing part can be of any desired configuration. It has proven to be particularly advantageous if the casing part has a first casing portion and a second casing portion, wherein the outside diameter of the second casing portion can be smaller than the outside diameter of the first casing portion. The second casing portion can then be provided for connecting the writing insert to the further components of the writing implement and the first casing portion can form an external contour of the writing implement. For example in that case the second casing portion can be in the form of a plug coupling which is fitted into a tubular sleeve of the writing implement which for example serves to receive the writing fluid, and is fluid-tightly fixed therein.

In that case the first casing portion can at least approximately be in the shape of a truncated cone. If the first casing portion is of an arcuate configuration in longitudinal section so that for example it is in the shape of the cut-off nose of an artillery shell, that shaping of the first casing portion acts like a magnifying glass and simplifies quality control. In addition the coil spring and the mode of operation thereof are rendered even better visible.

If moreover the outside peripheral surface of the first casing portion and/or the inside peripheral surface of the through cavity at least in the region of the first casing portion is polished, the optical effect is enhanced thereby.

In order to permit the spring element to be supported against the writing member, it is further possible to provide a clamping sleeve which is mounted fixedly to the writing member. In order to implement that, the clamping sleeve can be fixed to the writing member by way of at least one deformation location. The deformation location can be formed for example by an indentation produced in the clamping sleeve by a special tool. It is particularly preferred for the clamping sleeve to be fixed to the writing member by way of a plurality of such deformation locations.

In order to permit the spring element to be securely supported against the clamping sleeve, it is further advantageous if, at its end facing towards the spring element, the clamping sleeve has an enlargement portion against which the spring element can be supported.

The guide device for the writing member can in principle be of any desired configuration. Depending on the respective configuration of the writing member for example the guide device can be formed by the second cavity portion of the through cavity. In order to permit secure guidance of the writing tip of the writing member, it is advantageous if the guide device alternatively and additionally thereto is formed by a guide sleeve which projects with a first sleeve portion out of the casing part in the direction of the writing tip and which extends with a second sleeve portion in the through cavity, the axial length of the second sleeve portion being smaller than the axial length of the spring element. That shortened structure for the guide device or the guide sleeve provides space in the casing part, in particular in the first cavity portion of the through cavity, for the coil spring. In comparison with the state of the art however, that is only made possible by virtue of the fact that the spring element is supported directly at the casing part.

The structure according to the invention is particularly advantageous for writing members which are of a diameter in the range of between 0.2 mm and 1.5 mm, preferably in the range of between 0.3 mm and 0.7 mm.

Further advantageous configurations and an embodiment of the invention will be described with reference to the accompanying Figure. It is to be noted in this connection that the terms 'left', 'right', 'top' and 'bottom' which are used in the description of the specific embodiment relate to the Figure with the reference numerals being normally readable.

The single Figure of the drawing shows a view in longitudinal section of a writing insert S according to the invention. The writing insert S according to the invention firstly comprises a casing part 10 which is preferably produced as a continuous structure from a transparent plastic material, in particular by an injection molding process, and which has a first, in particular casing portion 10*a* and a second casing portion 10*b* which adjoin each other in succession in the longitudinal direction of the casing part 10. The first casing portion 10*a* which forms an outer peripheral surface of the writing implement (not shown) is of an arcuate external contour in longitudinal section, being in particular in the shape of the cut-off nose of an artillery shell. The second casing portion 10*b* which adjoins the first casing portion 10*a* towards the right is in the shape of a sleeve of circular cross-section, wherein the outside diameter of the sleeve is smaller than the outside diameter of the directly adjoining region of the first casing portion 10*a*. Preferably the outside diameter of the second casing portion 10*b* can be of the same outside diameter as the left-hand end 10*c* of the first casing portion 10*a*. The second casing portion 10*b* serves as a connecting part to a fluid reservoir (not shown) of the writing implement in which the writing insert S according to the invention is used. In particular the outside peripheral surface of the second casing portion 10*b* can serve as a connecting and fixing surface for fluid-tightly connecting the writing insert S to the reservoir. The surface 10*d* which is to be found at the transition from the first casing portion 10*a* to the second casing portion 10*b* and which preferably extends vertically with respect to the longitudinal central axis of the writing insert S can serve as a mounting surface for the fluid reservoir of the writing implement. In that respect the fluid reservoir can be formed by a fluid tank in which the writing fluid is freely flowingly accommodated or it can be formed by a capillary storage means or a fiber storage means in which the writing fluid is accommodated in 'bound' form. It will be appreciated that the second casing portion 10*b* can be a connecting part to any other functional component of the writing implement.

Provided in the interior of the casing part 10 is a through cavity 14 which extends entirely through the casing part 10 from the left-hand end 10*c* thereof to the right-hand end 10*e*, coaxially with respect to the longitudinal central axis L of the writing insert S. The through cavity 14 has a first cavity portion 14*a* which extends from the left-hand end 10*c* into the interior of the casing part 10. That is followed by a second cavity portion 14*b* whose inside diameter is smaller than the inside diameter of the first cavity portion 14*a*. Formed at the transition from the first cavity portion 14*a* to the second cavity portion 14*b* is a support surface 16 which preferably extends vertically with respect to the longitudinal central axis L of the writing insert S. Further adjoining that arrangement in a direction towards the right-hand end 10*e* of the casing part 10 is a third cavity portion 14*c* whose diameter is in turn larger than the inside diameter of the second cavity portion 14*b* but smaller than the inside diameter of the first cavity portion 14*a*. It should also be noted that the first, the second and the third cavity portions 14*a*, 14*b*, 14*c* are preferably of a circular cross-section.

A writing member 20 which is of a circular cross-section is arranged in the through cavity 14 also in coaxial relationship with the longitudinal central axis L of the writing insert S. The writing member 20 which is preferably made from a hard extruded plastic material, in particular polyacetal, extends beyond the right-hand end 10*e*, which is shown in the Figure, of the casing part 10 into the fluid reservoir of the writing implement (not shown). At the left-hand end 10*c* the writing member 20 projects out of the casing part 10 and there has a writing tip 20*a* which is rounded. "The writing member 20 is guided and held in its position by a guide device in the form of a guide sleeve 30, preferably of metal, in which respect the writing member 20 can be freely rotatable in the guide sleeve 30. For that purpose the guide sleeve 30 has a first sleeve portion 30*a* which is of an inside diameter corresponding to the outside diameter of the writing member 20 and which is outside the casing part 10 or the first casing portion 10*a*. A second sleeve portion 30*b* of the guide sleeve 30 is fixed in an annular recess 10*f* of the casing part 10, for example by adhesive or by being pressed therein, the recess extending from the left-hand end 10*c* into the interior of the first cavity portion 14*a*. The annular recess 10*f* is of an axial length which is less than the axial length of the first cavity portion 14*a* and is of such an inside diameter that, when the guide sleeve 30 is inserted, the inside diameter of the guide sleeve 30 blends smoothly into the inside diameter of the first cavity portion 14*a*. As can be seen from the Figure the guide sleeve 30 is provided with a cone portion 30*c* which forms the transition from the first sleeve portion 30*a* to the second sleeve portion 30*b*."

In addition mounted on the writing member 20 is a clamping sleeve 40 which is fixedly connected to the writing member 20 by way of deformation locations, in particular indentations. At its left-hand end 40*a* the clamping sleeve 40 is supported against the guide sleeve 30, in particular the first sleeve portion 30*a*, whereas at its right-hand end 40*b* it has an enlargement portion.

A spring element 50 in the form of a coil spring of metal is provided between the clamping sleeve 40 and the support surface 16. The coil spring 50 is supported with its left-hand end against the enlargement portion 40*b* of the clamping sleeve 40 and bears against the support surface 16 with its right-hand end, as has already been referred to above.

The invention claimed is:

1. A writing insert for a writing implement and the like, in particular for a fineliner writing implement, including a writing member (20) having a writing tip (20*a*), a casing part (10) having a through cavity (14) in which the writing member (20) is at least partially accommodated and from the one end (10*a*) of which the writing member (20) projects with the writing tip (20*a*), the through cavity (14) of the casing part (10) has at least a first cavity portion (14*a*) in which the spring element (50) is accommodated, a second cavity portion (14*b*) whose inside diameter is smaller than the inside diameter of the first cavity portion (14*a*) and a third cavity portion (14*c*) integrally formed with and extending from the second cavity portion (14*b*) whose inside diameter is greater than the inside diameter of the second cavity portion (14*b*), a guide device (30) connected to the casing part (10) for guiding the writing member (20) and a spring element (50) which elastically biases the writing member (20) in the direction of the writing tip (20*a*), wherein the spring element (50) is supported directly at the casing part and supported at a transitional step (16) from the first cavity portion (14*a*) to the second cavity portion (14*b*) and the casing part (10) is made from a transparent plastic material.

2. A writing insert for a writing implement and the like, in particular for a fineliner writing implement, including a writing member (20) having a writing tip (20*a*), a casing part (10) having a through cavity (14) in which the writing member (20) is at least partially accommodated and from the one end (10*a*) of which the writing member (20) projects with the writing tip (20*a*), the through cavity (14) of the casing part (10) has at least a first cavity portion (14*a*) in which the spring element (50) is accommodated and a second cavity portion (14*b*) whose inside diameter is smaller than the inside diameter of the first cavity portion (14*a*), a guide device (30) connected to the casing part (10) for guiding the writing member (20) and a spring element (50) which elastically biases the writing member (20) in the direction of the writing tip (20*a*), wherein the spring element (50) is supported directly at the casing part and supported at a transitional step (16) from the first cavity portion (14*a*) to the second cavity portion (14*b*) and the casing part (10) is made from a transparent plastic material and wherein the guide device is formed by a guide sleeve (30) which projects from the casing part (10) with a first sleeve portion (30*a*) in the directed of the writing tip (20*a*) an which extends with a second sleeve portion (30*b*) into the through cavity (14), the axial length of the second sleeve portion (30*b*) being less than the axial length of the spring element (50).

3. A writing insert as set forth in claim 1 or 2 characterised in that the inside diameter of the second cavity portion (14*b*) corresponds to the outside diameter of the writing member (20).

4. A writing insert as set forth in claim 1 or 2 characterised in that the casing part (10) has a first casing portion (10*a*) and a second casing portion (10*b*), the diameter of the second casing portion (10*b*) being smaller than the diameter of the first casing portion (10*a*).

5. A writing insert as set forth in claim 4 characterised in that the first casing portion (10*a*) is at least approximately in the shape of a truncated cone.

6. A writing insert as set forth in claim 4 characterised in that the first casing portion (10*a*) is of an arcuate configuration in longitudinal section and preferably is at least approximately in the shape of the nose of an artillery shell.

7. A writing insert as set forth in claim 4 characterised in that the outside peripheral surface of the first casing portion (10*a*) and/or the through cavity (14) in the region of the first casing portion (10*a*) is polished.

8. A writing insert as set forth in claim 1 or 2 characterised in that the spring element is a coil spring (50), preferably of metal.

9. A writing insert as set forth in claim 1 or 2 characterised in that the spring element (50) is supported by way of a clamping sleeve (40) against the writing member (20).

10. A writing insert as set forth in claim 9 characterised in that the clamping sleeve (40) is fixed to the writing member (20) by way of at least one deformation location.

11. A writing insert as set forth in claim 9 characterised in that at its end (40*b*) facing towards the spring element (50) the clamping sleeve (40) has an enlargement portion against which the spring element (50) is supported.

12. A writing insert as set forth in claim 1 characterised in that the guide device is formed by a guide sleeve (30) which projects from the casing part (10) with a first sleeve portion (30*a*) in the direction of the writing tip (20*a*) and which extends with a second sleeve portion (30*b*) into the through cavity (14), the axial length of the second sleeve portion (30*b*) being less than the axial length of the spring element (50).

13. A writing insert as set forth in claim 12 or 2 characterised in that the inside diameter of the second sleeve portion (30*b*) corresponds to the inside diameter of the through cavity (14).

14. A writing insert as set forth in claim 1 or 2 characterised in that the writing member (20) is of a diameter in the range of between 0.2 mm and 1.5 mm.

* * * * *

UNITED STATES PATENT AND TRADEMARK OFFICE

CERTIFICATE OF CORRECTION

PATENT NO. : 7,147,394 B2
APPLICATION NO. : 10/477536
DATED : December 12, 2006
INVENTOR(S) : Gerhard Möck It is certified that error appears in the above-identified patent and that said Letters Patent is hereby corrected as shown below:

Col. 6, Line 57
Claim 2 line 22, "an" should be corrected to read --and--.

Signed and Sealed this

Twelfth Day of June, 2007

JON W. DUDAS
*Director of the United States Patent and Trademark Office*